United States Patent [19]

Terenzoni

[11] Patent Number: 4,676,044

[45] Date of Patent: Jun. 30, 1987

[54] METHOD OF CONSTRUCTING A DORMER WHILE PRESERVING THE EXISTING ROOF

[76] Inventor: Robert Terenzoni, 98 Boston Ave., Medford, Mass. 02155

[21] Appl. No.: 864,401

[22] Filed: May 18, 1986

[51] Int. Cl.[4] ..... E04G 23/06

[52] U.S. Cl. ..... 52/741; 52/92

[58] Field of Search ..... 52/64, 66, 69, 70, 90, 52/92, 94, 741, 745, 641, 71, 72, 640

[56] References Cited

U.S. PATENT DOCUMENTS

| | | | |
|---|---|---|---|
| 3,611,659 | 10/1971 | Greenhalgh | 52/92 |
| 3,713,258 | 1/1973 | Svensson | 52/90 |
| 3,863,419 | 2/1975 | Hendrich | 52/71 |

FOREIGN PATENT DOCUMENTS

| | | | |
|---|---|---|---|
| 478835 | 10/1915 | France | 52/90 |
| 1023789 | 12/1952 | France | 52/92 |

*Primary Examiner*—James L. Ridgill, Jr.
*Attorney, Agent, or Firm*—Robert L. Nathans

[57] ABSTRACT

Method of creating a dormer, under any weather conditions, of any length up to the length of an existing gable roof, and involves cutting through portions of an existing roof section to establish a new dormer roof to enable the old roof to be saved, thereafter elevating the newly established dormer roof with respect to the remaining portions of the existing roof structure, and constructing a first dormer wall section under the outer edge portion of the dormer roof substantially parallel to the length of the roof, and constructing second and third dormer wall sections under the side portions of the newly created dormer roof. Preferably, the step of elevating the cutout dormer roof includes cutting away upper portions of the rafters after they are rotatably coupled together with hinged brackets.

14 Claims, 3 Drawing Figures

METHOD OF CONSTRUCTING A DORMER WHILE PRESERVING THE EXISTING ROOF

BACKGROUND OF THE INVENTION

This invention relates to the field of modifying existing structures and more particularly methods of constructing shed dormers.

In present methods of constructing dormers, the existing roof is partially destroyed and a new dormer roof section is constructed, along with the side wall sections making up the dormer. After the roof section is destroyed, the dormer cannot usually be built in adverse weather conditions, and dismantling and dumping costs are incurred because the old roof materials must be removed from the premises. Also, it is particularly desirable to save an existing roof made from tile, slate or shingle in good condition, to eliminate costs of new materials which would otherwise be required.

SUMMARY OF PREFERRED EMBODIMENTS OF THE INVENTION

It is thus an object of this invention to provide a method of building a dormer which enables the builder to save the existing roof.

It is a further object of this invention to provide a method of constructing a dormer which may be performed in poor weather conditions, and which additionally reduces the cost of transporting old roof materials from the job site to a dump.

It is a further object of this invention to provide a method of constructing a dormer which is less costly than prior methods.

The invention features a method of creating a dormer of any length up to the length of an existing roof and involves cutting through portions of an existing roof section to establish a new dormer roof, thereafter elevating the newly established dormer roof with respect to the remaining portions of the existing roof structure, thereafter constructing a first dormer wall section under the outer edge portion of the dormer roof substantially parallel to the length of the roof, and constructing second and third dormer wall sections under the side portions of the newly created dormer roof. Preferably, the step of elevating the cutout dormer roof includes cutting away upper portions of the rafters after they are rotatably coupled together with hinged brackets. One set of rafters is angularly rotated with respect to a second set of rafters until the cutout dormer roof assumes the desired elevated position. Shoring is provided under the hinged brackets, and the dormer roof is preferably elevated by a set of jacks positioned under outer portions of the rafters under the dormer roof.

DISCLOSURE OF A PREFERRED METHOD

Other objects, features and advantages of this invention will become apparent upon studying the following disclosure taken in conjunction with the Figures in which.

Figure 1:
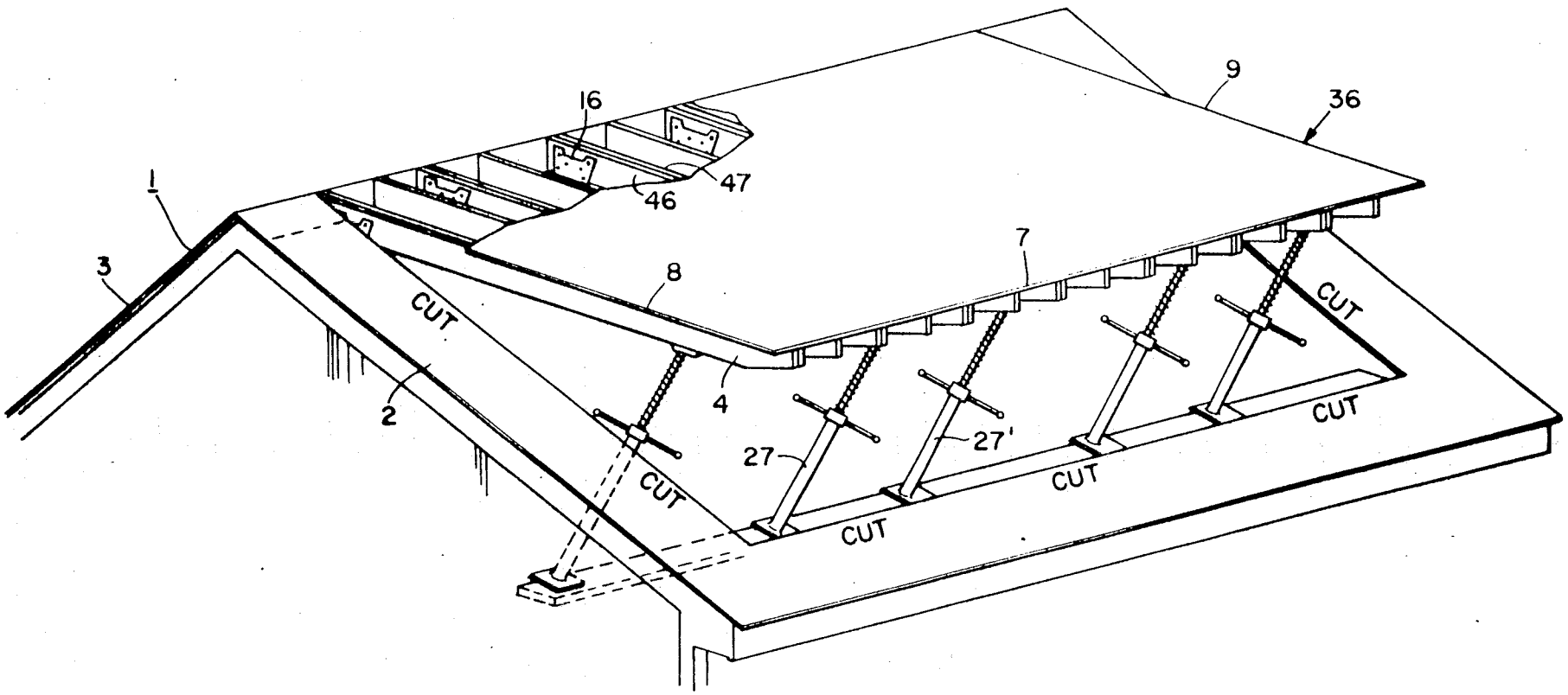
FIG. 1 illustrates an axonometric view of key components of the roof.

As shown in FIG. 1, gable roof 1 is made up of a first roof section 2 and a second roof section 3. The first roof section has a first set of rafters including rafter 4 for supporting the roof, whereas the second roof section has a second set of rafters including rafter 6 illustrated in FIG. 3.

In accordance with my preferred method, the first step is to double every second or third rafter as indicted in FIG. 1 by nailing a precut and angled rafter 46 to the original rafter 47. The hinged U-brackets are thereafter bolted to every second or third doubled rafter depending upon the weight of the roof. These units comprise a first bracket section 16 coupled to a second bracket section 17 via a hinge 18 shown in FIG. 2.

A cut is now made through the first roof section 1 along line 7 in a direction parallel to the length of gable roof 1. Side cuts 8 and 9 are also made through the roof, perpendicular to the length thereof, so as to establish the dormer roof section 36. The U-brackets affixed to some of the first and second sets of rafters enable the rotation of the cutout dormer roof 36 to the newly elevated position, such rotation being indicted by arrow 21 in FIG. 2. A first side portion 22 of U-bracket 16 is bolted to a first side portion of rafter 4 by bolts such as bolt 23, whereas a second side portion of bracket 16 namely portion 24 is bolted to the opposite side of rafter 4 as indicated in FIG. 3. The bottom of the U-brackets rest against the bottom of the rafters. The second bracket section 17 is similarly affixed to one of the rafters 6 of the second rafter set which is partially doubled as shown in FIG. 3, to receive bracket 17. The reason for this is in case the second side is to be made into a dormer, in which case bracket 17 would receive a full length double rafter. Temporary shoring jacks 26 are positioned directly under hinge 18 of each bracket, and a number of jacks 27 are positioned under outer portions of the first set of rafters. Also, temporary shoring pieces 31 are positioned under the second existing roof section of the gable roof 1. V-cut's are now made at the uppermost portions of the first sets of rafters to set the stage for the rotation of the first set of rafters, including rafter 4, with respect to the second set of rafters including rafter 6, which will remain stationary. Such a V-cut is shown at 11 in FIG. 2.

The dormer roof 36 is elevated, by actuating jacks 27, to the positon shown, and the newly formed dormer roof is now adequately supported while the side walls are constructed under side dormer roof edge portions 8 and 9 and under the outer dormer roof edge portion 7. After construction of the side wall portions, the rafters should be nailed, ceiling joists installed, and the jacks, shoring devices and hinges are removed.

Figure 2:
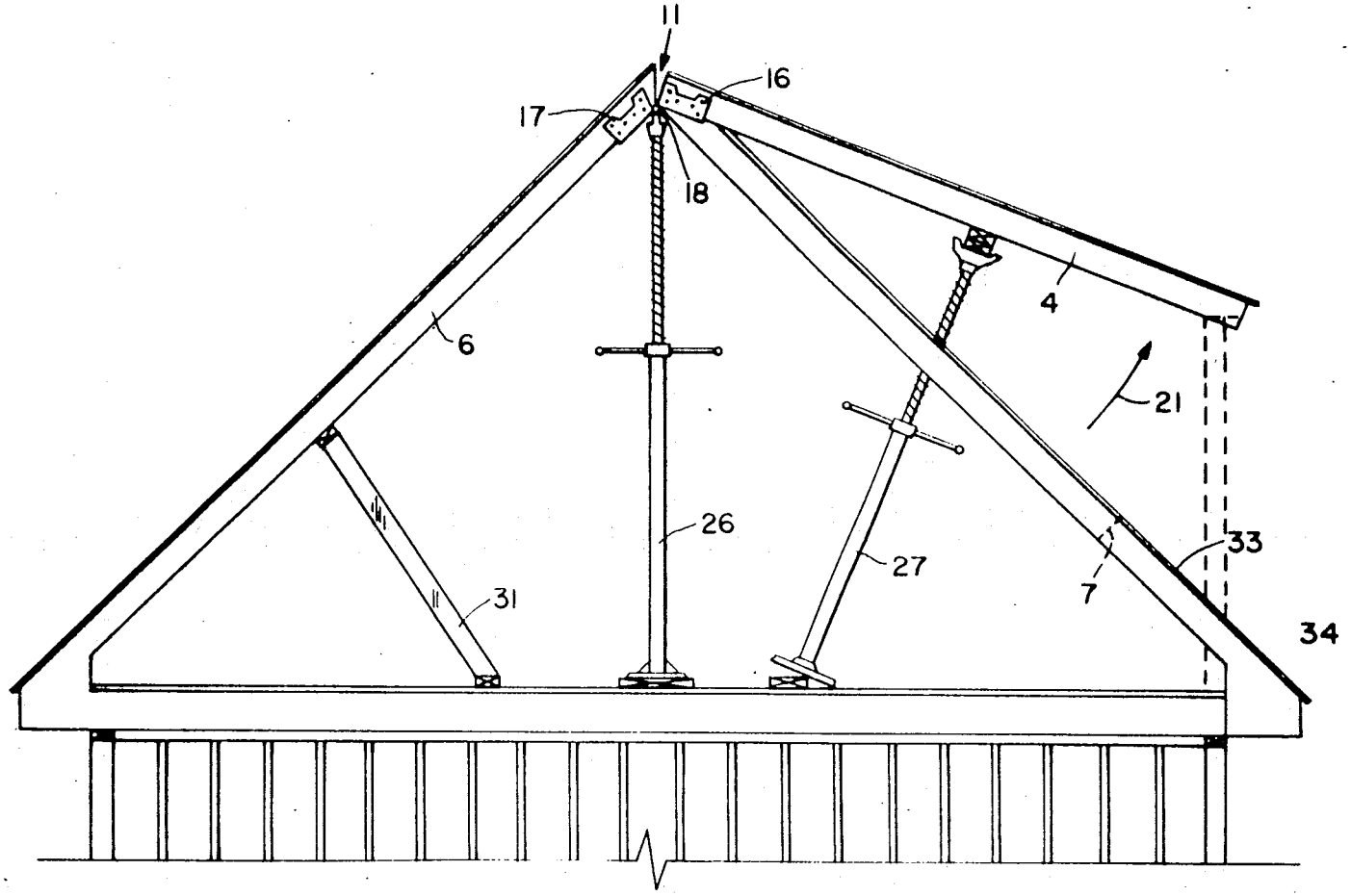
FIG. 2 illustrates a side view of the roof.
Figure 3:
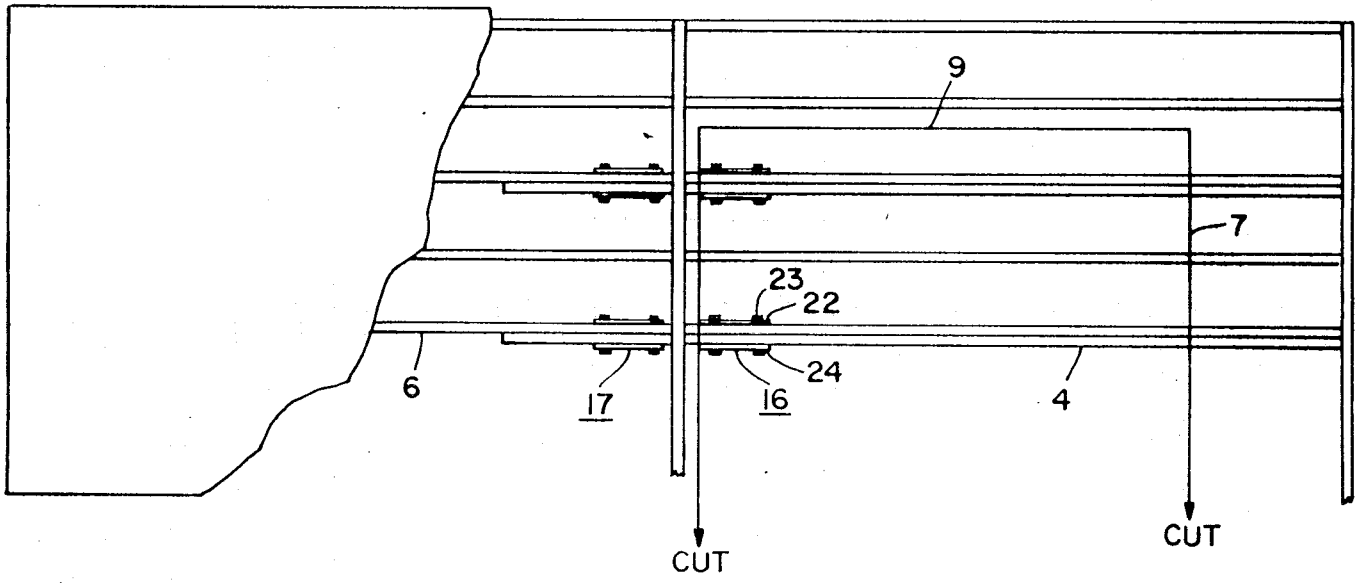
FIG. 3 illustrates a top view of the roof.

In summary, cutouts are made in the peaks of the intersecting first and second sets of rafters to facilitate the rotation of the first set of rafters with respect to the second set after U-bracket devices are coupled to the first and second sets of rafters at the upper most portions thereof preferably by bolting the old roof is cut, and jacks are utilized to produce the relative rotation of the dormer roof to its elevated position illustrated in FIGS. 1 and 2. The wall portions are thereafter constructed under the newly formed dormer roof.

It should now be appreciated that in accordance with the preferred method of my invention, the existing roof has been saved, and the cost of dismantling and removing the old roof components has additonally been eliminated. Furthermore, in accordance with my method, the new dormer may be constructed under poor weather conditions since the existing roof need not be removed. The cost to the builder of the devices employed in the practise of my method is quite small as the hinged brackets are inexpensive to manufacture and are reuseable. The length of each bracket section 16 and 17 is preferably about 9 inches, the width of the brackets is about 3.50 inches, and the height of each bracket section is about 5.5 inches. It would be very unusual for any two rafters coupled together to be over 3.5 inches in width. Old house rafters are sometimes a full two inches wide but when coupled with the added one and a half inch wide rafter, it makes up the correct 3.5 inch width. When a filler is necessary, a one half inch plywood can be used. Also, the second side or fixed side can be raised without resetting or shoring the hinges after the first side is complete.

While the above described method of practising my invention is preferred, other steps may be utilized to practise the invention, and thus the invention is to be limited only by reasonable interpretation of the language of the following claims and art recongnized equivalents thereof.

What is claimed is:

1. A method of creating a dormer, having a dormer roof of a variable length and created from a previously constructed, non-prefabricated, conventional gable roof having first and second intersecting roof sections with first and second sets of rafters under said first and second roof sections respectively, comprising the steps of:

(a) rotatably coupling at least some of the rafters of said first and second sets of rafters together by affixing rotatable coupling means to upper portions of said first and second sets of rafters;

(b) supporting said first and second sets of rafters;

(c) cutting away upper portions of said first set of rafters to permit angular rotation of said first set of rafters with respect to said second set of rafters;

(d) cutting through portions of said first roof section of said previously constructed, non-prefabricated, conventional, gable roof in a direction substantially parallel to the length of said roof to establish an outer dormer roof portion;

(e) cutting through portions of said first roof section in directions substantially perpendicular to the length of said roof to establish opposite dormer roof side portions of said dormer roof;

(f) thereafter rotating and lifting said dormer roof with respect to remaining portions of said first roof section;

(g) constructing a first wall section under said outer portion of said dormer roof, substantially parallel to the length of said roof; and (h) constructing second and third wall sections under said opposite side portions of said dormer roof substantially perpendicular to the length of said roof.

2. The method of claim 1 wherein step (b) includes jacking up said first set of rafters at outer portions thereof adjacent said outer portions of said dormer roof.

3. The method of claim 1 including the step of removing said coupling means from said rafters after carrying out step (h), to enable said coupling means to be reused.

4. The method of claim 1 wherein said coupling means comprises a plurality of brackets having first bracket sections coupled to second bracket sections through hinge devices, and wherein step (a) includes affixing said first bracket sections to upper portions of at least some of said first sets of rafters, and affixing said second bracket sections to upper portions of at least some of said second sets of rafters.

5. The method of claim 4 wherein step (b) includes supporting said coupling means under said hinge devices.

6. The method of claim 5 including the step of removing said plurality of brackets from said rafters after carrying out step (h), to enable said brackets to be reused.

7. The method of claim 4 wherein said brackets are u-shaped, and wherein step (a) includes attaching said brackets to bottom and side portions of said rafters.

8. The method of claim 4 including the step of removing said plurality of brackets from said rafters after carrying out step (h), to enable said brackets to be reused.

9. The method of claim 8 wherein said brackets are u-shaped, and wherein step (a) includes attaching said brackets to bottom and side portions of said rafters.

10. The method of claim 4 wherein step (b) includes jacking up said first set of rafters at outer portions thereof adjacent said outer portions of said dormer roof.

11. The method of claim 10 wherein said brackets are u-shaped, and wherein step (a) includes attaching said brackets to bottom and side portions of said rafters.

12. The method of claim 10 wherein step (b) includes supporting said coupling means under said hinge devices.

13. The method of claim 12 including the step of removing said plurality of brackets from said rafters after carrying out step (h), to enable said brackets to be reused.

14. The method of claim 12 wherein said brackets are u-shaped, and wherein step (a) includes attaching said brackets to bottom and side portions of said rafters.

* * * * *